US009624629B2

(12) United States Patent
Yun

(10) Patent No.: US 9,624,629 B2
(45) Date of Patent: Apr. 18, 2017

(54) TRAFFIC CONE HAVING ALARM FUNCTION

(71) Applicant: So Young Yun, Daegu (KR)

(72) Inventor: So Young Yun, Daegu (KR)

( * ) Notice: Subject to any disclaimer, the term of this patent is extended or adjusted under 35 U.S.C. 154(b) by 164 days.

(21) Appl. No.: 14/414,703

(22) PCT Filed: Jul. 18, 2013

(86) PCT No.: PCT/KR2013/006411
§ 371 (c)(1),
(2) Date: Jan. 13, 2015

(87) PCT Pub. No.: WO2014/014280
PCT Pub. Date: Jan. 23, 2014

(65) Prior Publication Data

US 2015/0204035 A1 Jul. 23, 2015

(30) Foreign Application Priority Data

Jul. 20, 2012 (KR) ..... 10-2012-0079547

(51) Int. Cl.
*E01F 9/012* (2006.01)
*G10K 9/04* (2006.01)
*E01F 9/688* (2016.01)
*E01F 9/654* (2016.01)

(52) U.S. Cl.
CPC ..... *E01F 9/0122* (2013.01); *E01F 9/654* (2016.02); *E01F 9/688* (2016.02); *G10K 9/04* (2013.01)

(58) Field of Classification Search
CPC ..... E01F 9/654; E01F 9/688; G10K 9/04
USPC ..... 116/63 P, 63 C, 63 T
See application file for complete search history.

(56) References Cited

U.S. PATENT DOCUMENTS 3,660,817 A * 5/1972 Abrams ..... G08B 3/00 116/63 C
5,265,556 A 11/1993 Hall
5,325,808 A * 7/1994 Bernoudy, Jr. ..... B60C 23/0496 116/272
6,075,450 A * 6/2000 Clark ..... E01F 15/00 340/546
7,423,552 B2 * 9/2008 Sherman et al. ..... G08G 1/164 116/63 P

FOREIGN PATENT DOCUMENTS

FR 2886952 A1 * 12/2006 ..... G08B 21/00
GB 2386730 A * 9/2003 ..... G08B 5/006
GB 2465214 A * 5/2010 ..... G08B 1/164
(Continued)

*Primary Examiner* — R. A. Smith
(74) *Attorney, Agent, or Firm* — Novick, Kim & Lee, PLLC; Jae Youn Kim

(57) ABSTRACT

A traffic cone having an alarm function is provided. The traffic cone is configured to blow an air horn by opening an air flow valve when an external impact occurs so that workers can escape a dangerous situation quickly, and to be mounted easily and conveniently to an existing traffic cone without any separate manufacturing process. Further, the traffic cone improves price competitiveness by reducing processes and costs with recyclable components, prevents environmental contamination, applies simplified structures, and improves precision, thereby greatly enhancing convenience and the product life.

3 Claims, 6 Drawing Sheets

(56) References Cited

FOREIGN PATENT DOCUMENTS

| | | | | | |
|---|---|---|---|---|---|
| JP | 11-350438 | A | | 12/1999 | |
| JP | 2007309079 | A | * | 11/2007 | ..... E01F 13/02 |
| KR | 20-0157079 | Y1 | | 9/1999 | |
| KR | 20-0228265 | Y1 | | 6/2001 | |
| KR | 20-0229370 | Y1 | | 7/2001 | |
| KR | 10-1078390 | B1 | | 10/2011 | |

* cited by examiner

TRAFFIC CONE HAVING ALARM FUNCTION

FIELD OF THE INVENTION

The present invention relates to a traffic cone that has a support installed on the ground and a cone body indicating danger. Specifically, the present invention relates to a traffic cone having alarm function that sounds an air horn by opening the valve when external impact occurs so that workers can escape a dangerous situation quickly, mounted easily and conveniently to the existing traffic cones without any separate manufacturing process, improves price competitiveness by reducing processes and costs with the existing and recyclable components, prevents environmental contamination, applies simplified structures, improves precision, thereby greatly enhancing convenience and the product life.

TECHNICAL BACKGROUND OF THE INVENTION

As roads including expressways are built and extended, traffic safety installations increase continuously to secure the safety of driving, and a lot of works are done for the maintenance of roads and installations every year. According to the related regulations, signs that inform danger (red light, protective color), signal equipments or traffic inducement personnel are required.

In a road construction site, traffic cones are installed at certain intervals to prevent the entry of cars to the worksite. If there is possibility that cars hit traffic cones by mistake, traffic inducement function is weakened and other cars may enter the worksite, causing an accident. Traffic cones have colors or reflectors to enhance the recognition of drivers, and it is not enough to prevent accidents.

In one example, Korean Registered Utility Model No. 0229370 discloses an apparatus that is used as a safety fence to control access of outsiders to a construction site when assembled and as a traffic cone to induce the pass of pedestrians or cars when disassembled.

In another example, Korean Registered Utility Model No. 0157079 discloses an apparatus that is conveniently portable to a worksite and waves a flag side to side with the flickering of warning light. However, this preceding technology uses relatively bigger traffic cones than general ones and multi-stage loading is hard, it has limited effectiveness in movement, installation and operation.

To solve this problem, the present applicant registered Korean Patent Publication No. 10-1078390 "Traffic Cone Having Alarm Function" before the present invention. Specifically, the present applicant's previous traffic cone comprises the support (20) equipped with the air tank (22) that is integrated or mounted detachably to the bottom of the cone body (10) and stores air pressure; the alarm unit that connects the air tank (22) to the pipeline (32) and the whistle (36) and has the on-off valve (34) on the pipeline (32); and 1st/2nd sensors (40)(60) that are interlocked with the cone body (10) and generate the actuating force for the on-off valve (34). When external impact is applied to the traffic cone filled with compressed air, the valve is open and the whistle is blown so that workers can escape a dangerous situation quickly.

However, the previous traffic cone sharply increases manufacturing costs because it is not compatible with the existing traffic cones. Specifically, the air tank (22) is required to store air pressure for the support (20), and all the components that perform the alarm function should be built in the air tank (22), which increases manufacturing processes and equipment costs and weakens price competitiveness.

It is also required to manufacture the components that perform the alarm function separately, which causes a waste of time and labor. Most of all, its complex structure degrades precision and makes maintenance difficult, thereby reducing the product life.

DESCRIPTION OF THE INVENTION

Technical Challenge

As an apparatus developed to solve the problems mentioned above, the present invention aims to provide a traffic cone having alarm function that sounds an air horn by opening the valve when external impact occurs so that workers can escape a dangerous situation quickly, mounted easily and conveniently to the existing traffic cones without any separate manufacturing process, improves price competitiveness by reducing processes and costs with the existing and recyclable components, prevents environmental contamination, applies simplified structures, improves precision, thereby greatly enhancing convenience and the product life.

Technical Solution

As a traffic cone that has a support installed on the ground and a cone body indicating danger, the present invention comprises the storage part equipped with the air tank and the injection valve mounted detachably to the support to store and fill air pressure; the alarm part that connects the air tank to the pipeline and the air horn, has the alarm valve on the pipeline with the flow tube that opens/closes the flow channel in the middle of the alarm valve and has the auxiliary valve with the actuating bar engaged with the flow tube to induce flow; and the sensor operation part that is exposed on the surface of the support, detects external impact and opens/closes the alarm valve.

The sensor operation part includes the sensor that is mounted on the case and flows back and forth and side to side and the flow board that contacts the bottom and rotates elastically.

The case of the sensor operation part includes the return groove on the bottom to return the sensor automatically and the detection ring that induces the movement of the sensor by external impact.

The case of the sensor operation part includes the cover with fixing bump on the top to prevent the penetration of foreign matters and fix the sensor in the middle.

The interpretation of the terms and the words used in this specification and the patent claims should not be limited to usual or dictionary definitions but they should be interpreted as meanings and concepts that comply with the technical ideas of the present invention based on the principle that the inventor can define the concept of terms properly to explain the invention in the best way. Therefore, the working example of the present invention given in this specification and the configuration indicated in the drawings is only one of the most desirable examples, not representing all the technical ideas of the present invention. Therefore, it is required to understand that there may be various equivalents and modifications that can substitute these examples at the point of the patent application.

Benefit from the Invention

As stated above, the present invention is a traffic cone having alarm function that sounds an air horn by opening the valve when external impact occurs so that workers can escape a dangerous situation quickly, mounted easily and conveniently to the existing traffic cones without any separate manufacturing process, improves price competitiveness by reducing processes and costs with the existing and recyclable components, prevents environmental contamination, applies simplified structures, improves precision, thereby greatly enhancing convenience and the product life.

DETAILED DESCRIPTION OF WORKING EXAMPLES OF THE INVENTION

Figure 1:
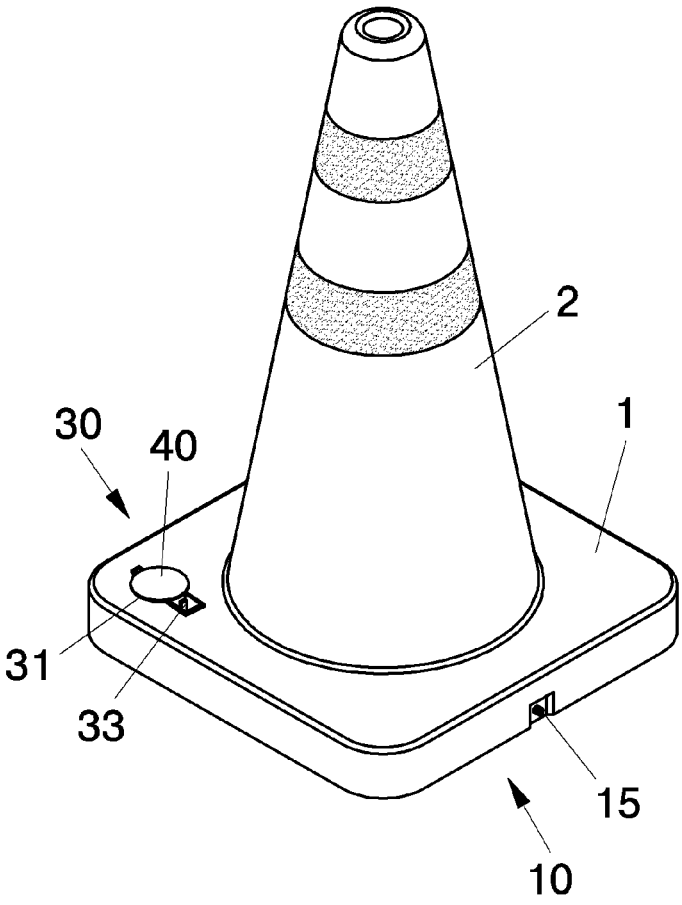
FIG. 1 is a perspective drawing that provides the overall view of the present invention.

Based on the attached drawings, the details of the working examples of the present invention are as described below.

The present invention relates to a traffic cone that has a support (1) installed on the ground and a cone body (2) indicating danger, specifically relating to a traffic cone having alarm function that comprises the storage part (10), the alarm part (20) and the sensor operation part (30). As an apparatus that has improved the manufacture, precision and usability-related problems of the present applicant's previous patented invention, which is Korean Patent Publication No. 10-1078390 "Traffic Cone Having Alarm Function", the present invention aims at the same purpose as the previous invention, i.e., to sound an air horn by opening the valve when external impact occurs so that workers can escape a dangerous situation quickly.

The main improvements of the present invention are to provide the alarm function by using the existing traffic cones without significant change of manufacturing processes, improve price competitiveness by simplifying structures and using the existing and recyclable components, prevent environmental contamination and improve convenience and precision.

Figure 2:
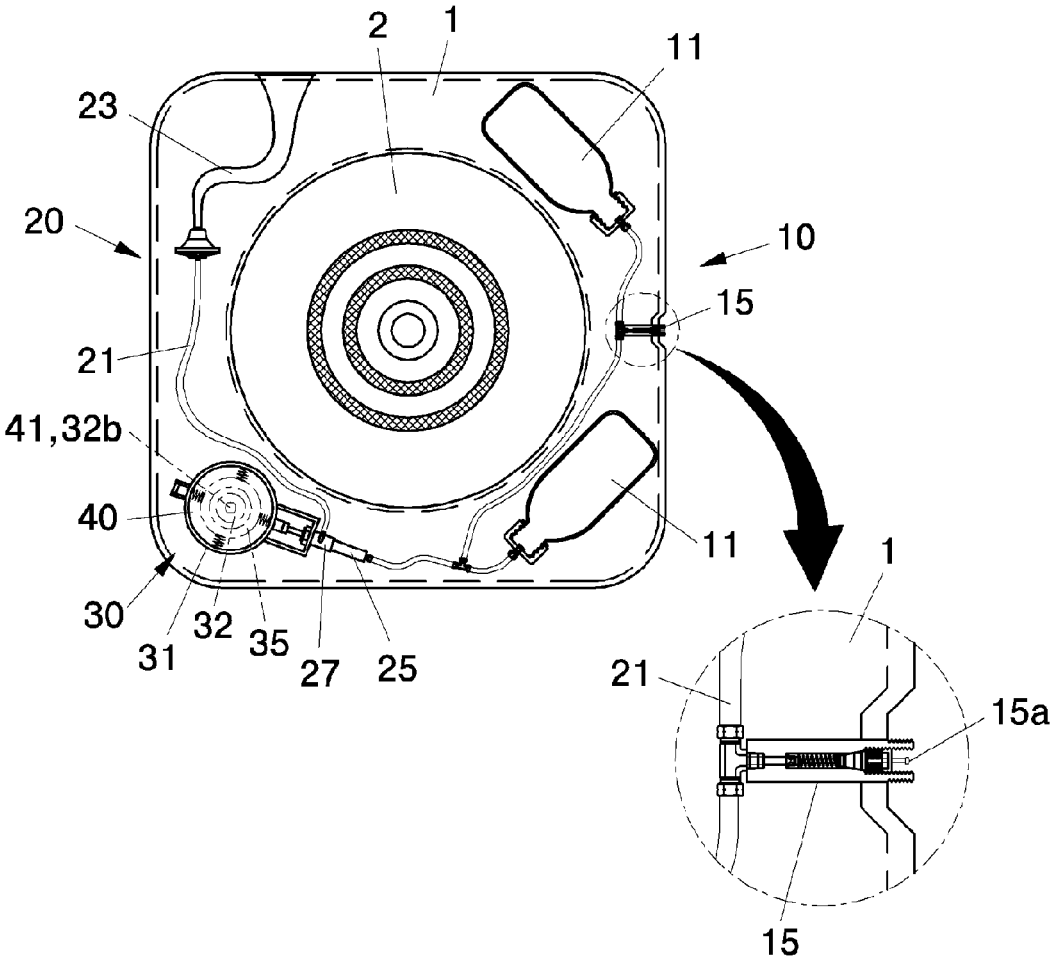
FIG. 2 is a floor plan that provides the overall perspective view of the present invention.

The storage part (10) of the present invention includes the air tank (11) and the injection valve (15) mounted detachably to the support (1) to store and fill air pressure. The storage part (10) has the function to store and recycle energy to sound alarm when external impact occurs, and the air tank (11) and the injection valve (15) are mounted on the bottom of the support (1) as shown in FIG. 2.

The air tank (11) is made of expandable/contractible materials to store air under a certain pressure. It is possible to made the air tank (11) with metallic materials but recommended to use resin materials for cost reduction. It is also possible to recycle PT bottles. The recommendation for the air tank (11) is that the air horn (23) should have enough capacity and pressure to sound the alarm of 100~160 dB for about 30~60 seconds. If using recycled PT bottles for the air tank (11), mounting may be difficult due to the narrow bottom space of the support (1) depending on capacity (more than 1.5 L). In this case, satisfactory alarm sound will be acquired by connecting PT bottles of low-capacity (350 mL) in parallel.

It is possible to manufacture the air tank (11) separately so that satisfactory alarm sound will be acquired with metallic or resin materials, but the most desirable method is to recycle PT bottles to prevent environmental contamination and reduce costs. The separately manufactured air tank (11) may be used for excellent durability and mounting. In any case, a person skilled in the art can select the separate manufacturing or the recycling as long as the air tank (11) is mounted detachably to the support (1).

The air tank (11) is mounted by various methods e.g., using adhesives such as glues or double-sided tapes or connecting materials such as straps or rings. The mounting methods are not limited but various methods can be used as long as change or damage of the shape of the support (1) is minimized.

To fill air in the air tank (11) under a certain pressure, the injection valve (15) is exposed on the surface of the support (1) and connected with the air tank (11) by the pipeline (21) that is described below. It is desirable to use the presta-type, schrader-type or dunlop-type injection valve (15) that is compatible with general injection valves. Among these types, the schrader-type that facilitates air injection and controls pressure is recommended. The schrader-type has a similar structure to a check valve that induces unidirectional flow to prevent backflow of fluid. As shown in FIG. 2, the flow tube (15*a*) that opens/closes the flow channel in the middle of the alarm valve is protruded (exposed) to adjust flow at the entrance.

It is also possible to use the presta-type or dunlop-type injection valve (15) as well as general tube-type valve made of resin materials. The tube-type has a structure that forms a flow membrane in the tube and is expanded automatically quickly without resistance if air is injected and contracted automatically if air injection is completed to prevent the discharge of air. The user can also discharge air (or adjust pressure) quickly if pressurizing the side of the tube to expand the tube. In any case, person skilled in the art can select one of the above types by taking into consideration of the compatibility with general injection valves, durability and cost reduction.

The alarm part (20) of the present invention connects the air tank (11) to the pipeline (21) and the air horn (23) and has the alarm valve (25) on the pipeline (21). To perform the alarm function so that alarm will sound when external impact occurs, the alarm part (20) has the air horn (23) and the alarm valve (25) in the bottom space of the support (1) as shown FIG. 2, all of which are connected to the storage part (10) through the pipeline.

The pipeline (21) where the air tank (11) and the injection valve (15) are cross-connected is branched off and connected to the entrance of the alarm valve (25), the air horn (23) is connected to the exit of the alarm valve (25). Soft tubes or hoses or hard pipes can be used for the pipeline, but the recommendation is to use soft materials that are cheap and easy to install. For cross-connection or branch-off of the air tank (11) and the injection valve (15), Y-type or X-type unions or nipples can be used, but the recommendation is to use one-touch fittings that are easy to install and maintain.

It is possible to connect a pressure gauge to the support (1) to confirm if proper air pressure is maintained in the air tank (11). If the air tank (11) has sufficient durability, the degree of expansion is visible by the naked eye or predictable by the operation of the injection pump, the installation of a pressure gauge may not be required.

The air horn (23) has a structure that sounds various alarms such as whistle and siren. When air of a certain pressure flows in (or is injected), sound of a certain loudness proportional to the air pressure is generated. The air horn (23) should have a small structure to mount on the bottom of the support (1) and generate sound of over 90 dB under low pressure. Above all, high-frequency sound is recommended rather than low-frequency sound so that workers can hear alarm sound in noisy environments.

The alarm valve (25) is interlocked with the sensor operation part (30) described below and flows air from the air tank (11) into the air horn (23) when external impact occurs. The alarm valve (25) stores air in the air tank (11) under a certain pressure and closes the pipeline (21) to prevent air in the air tank (11) to flow into the air horn (23) in normal situations, while it flows air into the air tank (11) when there in external impact to sound alarm.

Figure 3:
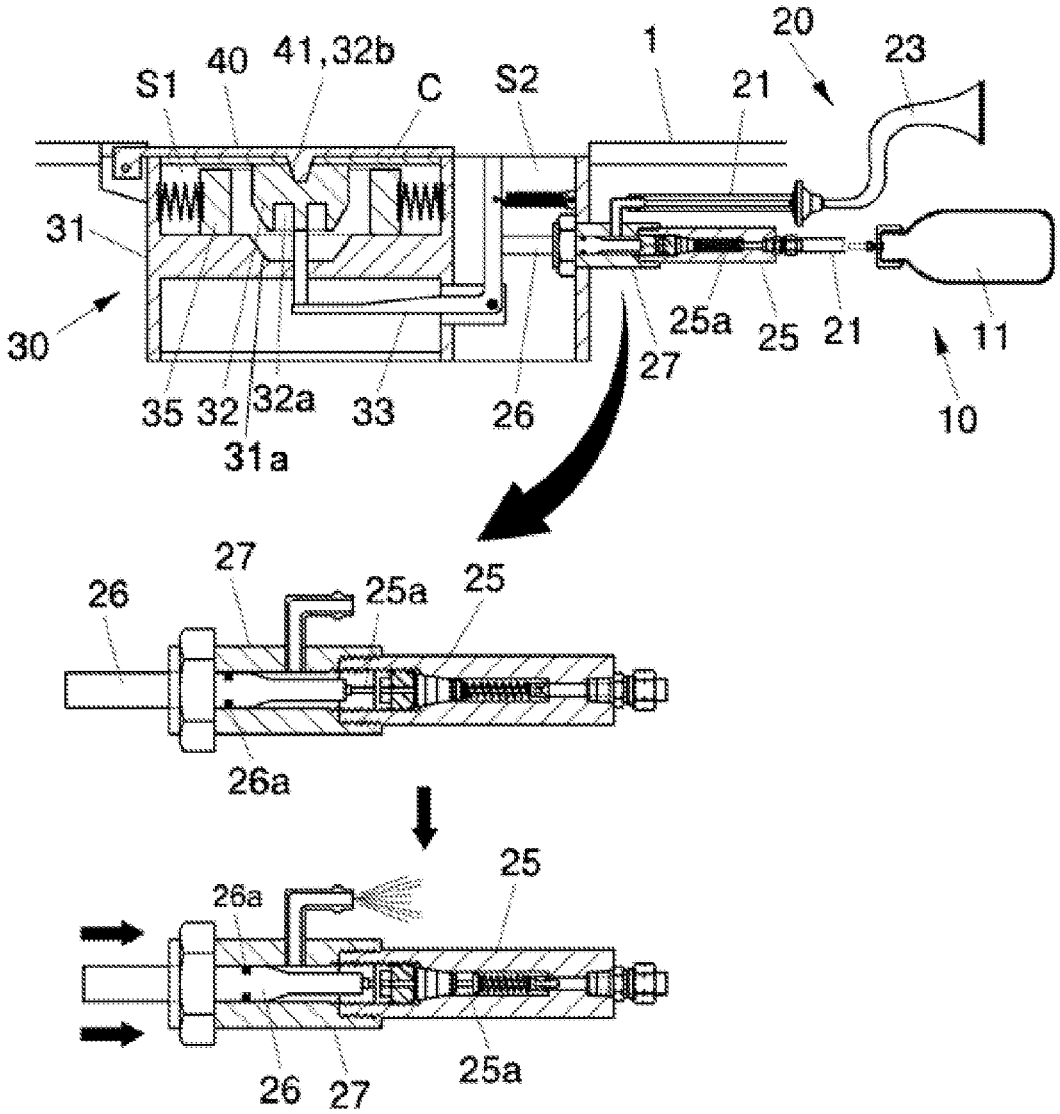
FIG. 3 is a configuration drawing that magnifies the main parts of the present invention.

The alarm valve (25) in the alarm part (20) has the flow tube (25*a*) that opens/closes the flow channel in the middle of the alarm valve and has the auxiliary valve with the actuating bar engaged with the flow tube to induce flow. As shown in FIG. 3, the alarm valve (25) has the flow tube (25*a*) with unidirectional elastic force by the spring in the middle. The Schrader-type valve is used to open/close the flow channel depending on the back and forth flow (left side and right side of the drawing) of the flow tube (25*a*). The schrader-type has a similar structure to a check valve that induces unidirectional flow to prevent backflow of fluid. As shown in FIG. 3, the flow tube (25*a*) that opens/closes the flow channel in the middle of the alarm valve is protruded (exposed) to adjust flow at the entrance.

The alarm valve (25) includes the auxiliary valve (27) with the actuating bar (26) engaged with the flow tube (25*a*) that is interlocked with the sensor operation part (30) and induce the connection with the air horn (23). As shown in FIG. 3, the auxiliary valve (27) has the actuating bar (26) in the middle that flows back and forth (left side and right side of the drawing). One end of the actuating bar (26) is engaged with the flow tube (25*a*), while the other end is engaged with the sensor operation part (30). The actuating bar (26) controls the discharge of air by the o-ring (26*a*) engaged closely with the auxiliary valve (27). If the actuating bar (26) pulls back the flow tube (25*a*) by the sensor operation part (30) and the alarm valve (25) is open, air is delivered from the air tank (11) through the pipeline (21) to the air horn (23). The back and forth flow of the actuating bard (26) will be detailed below with the explanation about the sensor operation part (30).

The sensor operation part (30) is exposed on the surface of the support (1), detects external impact and opens/closes the alarm valve (25). To perform the alarm function by opening the alarm valve (25) and making alarm sound when external impact occurs, the sensor operation part (30) is partially exposed on the surface of the support (1) as shown in FIG. 2. If external impact is applied to either the support (1) or the cone body (2), the sensor operation part (30) detects the impact on a real-time basis and actuates the alarm valve (25).

The sensor operation part (30) may be operated mechanically or electrically/electronically, i.e., the sensor operation part (30) is divided into the mechanical type and the electronic/electric-type. The electric/electronic type is recharged continuously without additional settings but expensive and required to check and charge the battery frequently. Above all, the electric/electronic type is likely to malfunction in humid or dusty environments and thus it is hard to use the electric/electronic type in poor environments such as the outside (worksite or construction field). The mechanical type is cheap and operated in all environments with high reliability but manual reset is required after a single operation.

Since it is most desirable to use the mechanical type for the sensor operation part (30), only the mechanical type will be explained in this specification. However, a person skilled in the art can use the electric/electronic type. No drawings are presented in this specification for the electric/electronic type. It is possible to use the solenoid-type for the alarm valve (25) and use PBC with an impact sensor or a position sensor. It is also possible to use the electronic-type speaker instead of the air horn (23) and omit the storage part (10) and the alarm valve (25). A person skilled in the art should use the mechanical-type for the sensor operation part (30) but the electric/electronic-type may be used depending on the use.

The sensor operation part (30) is mounted in the bottom space of the support (1) adjacent to the alarm valve (25) for interlocking. It should be partially exposed on the top or side of the support (1). In case of the electric/electronic-type, the sensor operation part (30) may not be exposed on the support (1). In case of the mechanical-type, it is desirable to make exposed to facilitate the control because manual reset is required after the operation. Such control will be detailed below.

The sensor operation part (30) includes the sensor (32) that is mounted on the case to flow back and forth and side to side and the flow board (33) that contacts the bottom and rotates elastically.

To perform the alarm function by opening the alarm valve (25) and making alarm sound when external impact occurs, the sensor operation part (30) has the case (31) in the bottom space of the support (1) adjacent to the alarm valve (25).

As shown in FIG. 3, the case (31) is divided into there the circle-type, the oval-type and the angle-type and has the detection space (S1) and the operation space (S2) inside and the cross-type or circle-type cover (C) on the top. The sensor (32) is mounted in the detection space (S1). Since the sensor (32) has a certain weight, it flows back and forth and side to side freely depending on external impact. The raised spot (32*a*) of a certain depth is located in the middle of the bottom of the sensor (32).

The operation space (S2) is located adjacent to the detection space (S1). The '⊏'-type flow board (33) rotated by the hinge are mounted in the operation space (S2). The actuating bar (26) that is engaged with the flow tube (25*a*) of the alarm valve (25) and moves linearly is exposed on one end. The flow board (33) has unidirectional elastic force by the spring. One end (the left side) is in the passage hole (H) contacts the middle of the bottom elastically, while the other end (right side) contacts one end of the actuating bar (26) selectively.

In the early stage, one end of the flow board (33) pressurizes the middle of the bottom of the sensor (33) by the spring as shown in FIG. 4*a*. When external impact occurs, the sensor (32) flows in the detection space (S1) as shown in FIG. 4*b*. In this process, one end of the flow board (33) moves from the middle of the bottom of the sensor (32) to the raised spot (32*a*). When one end of the flow board (33) moves to the raised spot (32*a*), it is rotated (in the right direction), and the other end pressurizes the actuating bar (26) of the alarm valve (25) and pulls back the flow tube (25*a*). When the flow tube (25*a*) is pulled back, the flow channel of the alarm valve (25) is open, and air flows from the air tank (11) through the open channel to the air horn, thereby generating alarm sound.

The case (31) of the sensor operation part (30) has the return groove (31*a*) on the bottom to return the sensor (32) automatically and the detection ring (35) that induces the movement of the sensor by external impact. The case (31) has the return groove (31*a*) and the detection ring (35) in the detection space (S1) with the sensor (32).

The return groove (31*a*) is inclined so that the sensor (32) in the middle of the bottom of the detection space (S1) will move automatically to the initial location. The returning process back to the initial state should be induced more easily and conveniently after alarm sounds by external impact (process from FIG. 4*a* to FIG. 4*b*). Since one end of the flow board (33) should deviate from the raised spot (32*a*) of the sensor (32) to return to the initial state for the detection function, the other end of the flow board (33) should be pulled manually.

In this state, pressure from the flow board (33) is released, and the sensor (32) drops by gravity and lands automatically on the return groove (31*a*) formed in the detection space (S1). The sensor (32) that lands on the return groove (31*a*) is located in the place where one end of the flow board (33) contacts the middle of the bottom elastically. If the manually pulled flow board (33) is released, it is returned to the initial state as shown in FIG. 4*a*. The above explanation about the process of returning to the initial state is to help understanding. The actual process of manually pulling the other end of the flow board (33) and immediately releasing for returning to the initial state is done in a very short moment.

Figure 4:
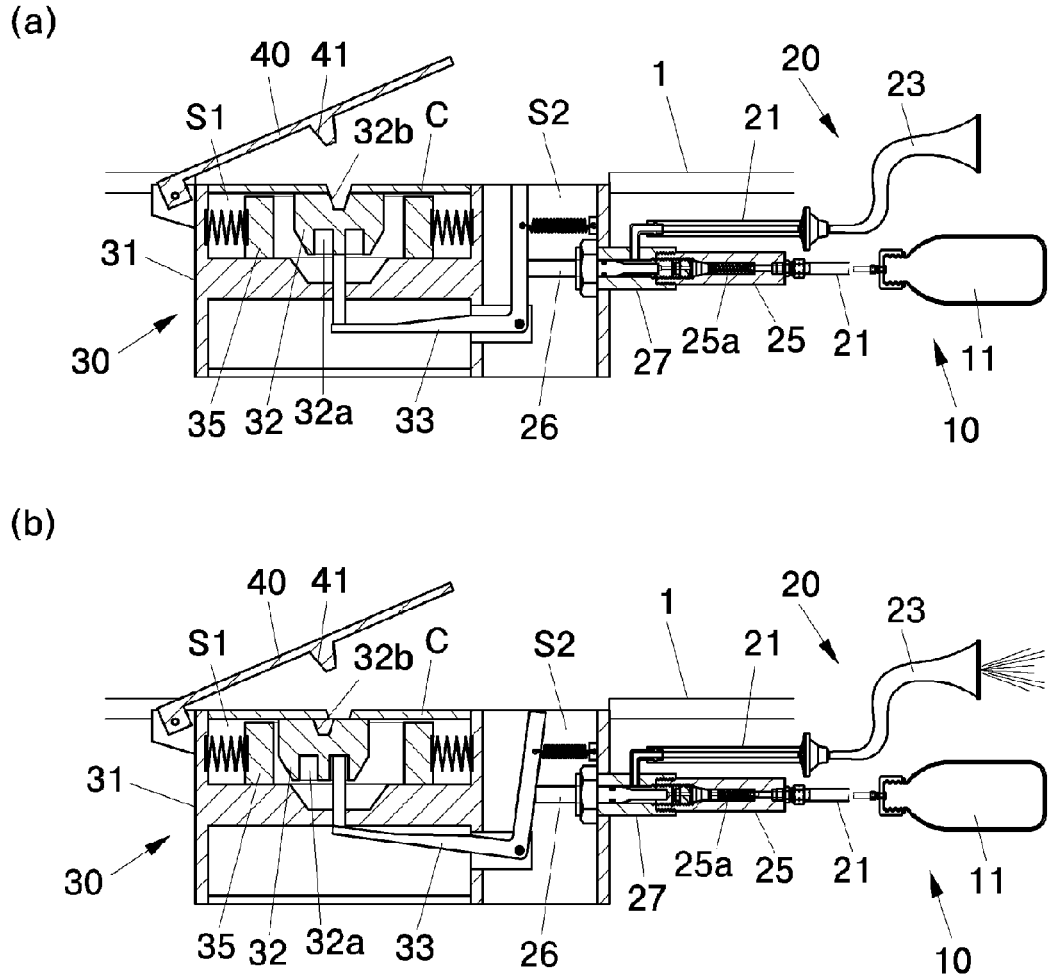
FIG. 4 and FIG. 5 are configuration drawings that show the operating state of the sensor operation part of the present invention.
Figure 5:
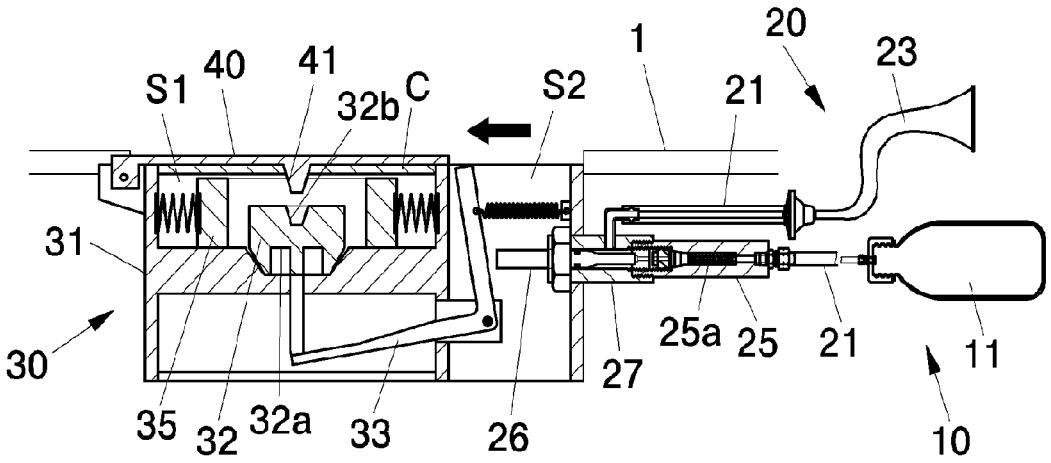

The detection ring (35) has the donut-shape as shown in FIG. 3-5, covers the outer surface of the sensor (32) and flows back and forth and side to side in the detection space (S1). The detection ring (35) induces the improvement of the external impact detection function of the sensor (32). The detection ring (35) itself is sufficient to detect external impact, but since one end of the flow board (33) pressurizes the middle of the bottom of the sensor (32) elastically, impact that is more intense than pressure is required. However, since the detection ring (35) also flows when external impact intensity is lower than pressure, the sensor (32) in the middle of the detection ring (35) is induced to move.

Since the spring returns the detection ring (35) to the middle, it is returned to the initial state after moving from the middle by impact. It is recommended to use lower spring constant of the detection ring (35) than the spring constant of the flow board (33).

The case (31) of the sensor operation part (30) has the cover (40) with the fixing bump (41) on the top to prevent the penetration of foreign matters and fix the sensor (32) in the middle. The case (31) has the detection space (S1) and the operation space (S2) and has the open/close-type cover (40) on the top of the detection space (S1) with the sensor (32).

The cover (40) has a structure to open/close the detection space (S1) of the case (31) to prevent the penetration of foreign matters. The cover (40) is mounted on one end of the case (31) and semi-automatically rotated by the hinge and the leaf spring. 'Semi-automatic' herein means that if the force of the cover (40) to close the detection space (S1) of the case (31) is maintained continuously and then the cover (40) is rotated artificially to open the detection space (S1), the force to open is maintained continuously. The semi-automatic rotation maintains a certain state continuously regardless of the occurrence of external impact.

The cover (40) has the fixing bump (41) that protrudes to fix the sensor (32) in the middle. The fixing bump (41) is engaged with the fixing groove (32*b*) on the top of the sensor (32). If not used (stored or transported), it controls the flow of the sensor (32) and inactivates the alarm function. If the cover (40) is rotated and the detection space (S1) is closed when not used, the fixing bump (41) is engaged with the fixing groove (32*b*) of the sensor (32) automatically and prevents the penetration of foreign matters, thereby enhancing the product life. If the cover (40) is rotated and the detection space (S1) is open when used, the fixing bump (41) is separated from the fixing groove (32*b*) of the sensor (32) automatically and performs the detection function.

The cover (40) can be extended to open/close the operation space (S2) as well as the detection space (S1).

Figure 6:
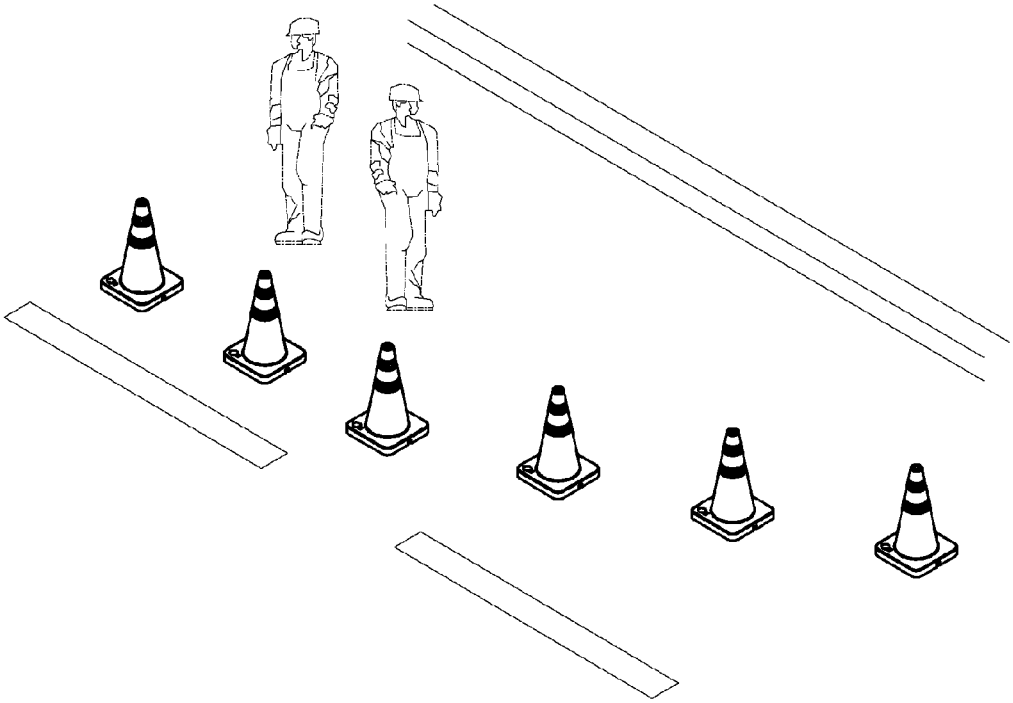
FIG. 6 and FIG. 7 are perspective drawings that show the use state of the present invention.
Figure 7:
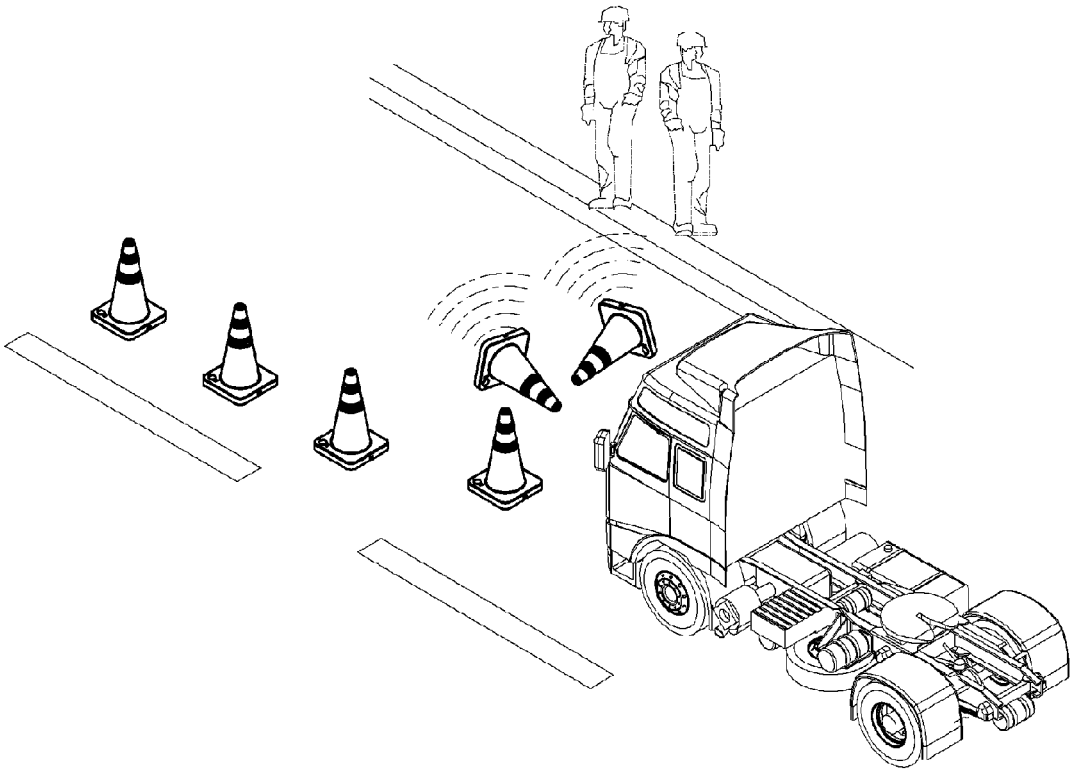

When using the present invention as shown in FIG. 6 and FIG. 7, i.e., in case that there is no monitoring personnel in a road construction site as shown in FIG. 6, the present invention rings alarm sound so that workers can respond to the sudden access of a car quickly, thereby assuring the safety of field workers by the way that is not possible by the traditional traffic cones. If a car driven by a drowsy driver enters the hazard zone, the present invention rings alarm sound so that the driver can respond quickly and prevent a fatal accident.

The present invention is a traffic cone having alarm function that sounds an air horn by opening the valve when external impact occurs so that workers can escape a dangerous situation quickly, mounted easily and conveniently to the existing traffic cones without any separate manufacturing process, improves price competitiveness by reducing processes and costs with the existing and recyclable components, prevents environmental contamination, applies simplified structures, improves precision, thereby greatly enhancing convenience and the product life.

There are other working examples of the present invention besides the given example, and it is obvious to a person with common knowledge in the field of this technology that the present invention is variously modifiable and transformable without deviation from the idea and the scope of the present invention. Therefore, the examples of such modifications and transformations fall into the scope of patent claims for the present invention.

[DESCRIPTION OF CODES]

| | | |
|---|---|---|
| 1: Support | 2: Cone Body | 10: Storage Part |
| 11: Air Tank | 15: Injection Valve | 15a, 25a: Flow Tube |
| 20: Alarm Part | 21: Pipeline | 23: Air Horn |
| 25: Alarm Valve | 26: Actuating Bard | 26a: O-ring |
| 27: Auxiliary Valve | 30: Sensor Operation Part | 31: Case |
| 31a: Return Groove | 32: Sensor | 32a: Raised Spot |
| 32b: Fixing Groove | 33: Flow Board | 35: Detection Ring |
| 40: Cover | 41: Fixing Bump | C: Cover |
| H: Passage Hole | S1: Detection Space | S2: Operation Space |

What is claimed is:

1. A traffic cone having an alarm function, the traffic cone comprising:

a support configured to be placed on the ground;

a cone body connected to the support;

a storage part including an air tank and an injection valve for injecting air to the air tank;

an alarm part including a pipeline connected to the air tank, an air horn, an alarm valve connected to the pipeline and having a flow tube configured to open or close a flow channel disposed in the alarm valve, and an auxiliary valve having an actuating bar engaged with the flow tube; and a sensor operation part configured to detect an external impact and to open or close the alarm valve, wherein the sensor operation part includes a sensor mounted on a case and configured to move back and forth and side to side and a flow board configured to contact a bottom of the sensor and rotate elastically.

2. The traffic cone having the alarm function of claim 1, wherein the case of the sensor operation part includes a return groove on the bottom to return the sensor automatically and a detection ring that induces a movement of the sensor by the external impact.

3. The traffic cone having the alarm function of claim 1, wherein the case of the sensor operation part includes a cover having a fixing bump to prevent a penetration of foreign matters and fix the sensor.

* * * * *